US005513450A

United States Patent [19]

Aviles Palazzo

[11] Patent Number: 5,513,450

[45] Date of Patent: May 7, 1996

[54] SAND SOCCER BOOT

[76] Inventor: Claudio L. Aviles Palazzo, 15835 Marlin Pl., Van Nuys, Calif. 91406

[21] Appl. No.: 303,819

[22] Filed: Sep. 9, 1994

[51] Int. Cl.[6] ..... A43B 5/02; A43B 5/04

[52] U.S. Cl. ..... 36/128; 36/89; 36/102; 36/114; 36/116; 36/71

[58] Field of Search ..... 36/88, 89, 83, 36/102, 105, 114, 116, 128, 9 R, 11, 11.5, 8.1, 1, 93, 10, 55, 50.1, 71

[56] References Cited

U.S. PATENT DOCUMENTS

| | | | |
|---|---|---|---|
| 2,287,026 | 6/1942 | Craig | 36/55 |
| 3,192,651 | 7/1965 | Smith | 36/105 |
| 3,325,919 | 6/1967 | Robinson | 36/93 |
| 3,667,140 | 6/1972 | Hunderford | 36/71 X |
| 4,296,558 | 10/1981 | Antonious | 36/50.1 |
| 4,559,722 | 12/1985 | Norton | 36/89 |
| 4,777,740 | 10/1988 | Akagi | 36/55 |
| 4,854,057 | 8/1989 | Misevich et al. | 36/114 |
| 4,914,837 | 4/1990 | Rieffel | 36/88 |
| 4,942,678 | 7/1990 | Gumbert | 36/102 |

FOREIGN PATENT DOCUMENTS

| | | | |
|---|---|---|---|
| 0022873 | of 1902 | United Kingdom | 36/128 |
| 0007669 | of 1905 | United Kingdom | 36/128 |

*Primary Examiner*—Paul T. Sewell
*Assistant Examiner*—Marie Denise Patterson

[57] ABSTRACT

A sand soccer boot with a soft foam elastomer layer having an inner layer, an outer layer, a lower portion, an upper portion, and an ankle portion. The ankle portion and the upper portion integrally form an open recess for insertion of a foot. The open recess has an elastic foam forming ankle support thereattached. The ankle support serves to conform to a user's ankle to prevent sand from entering. A leather outer layer has an inner surface, an outer surface, a lower portion, an upper portion, and an ankle portion. The inner surface is secured to the outer layer of the soft foam elastomer layer. An elastomer sole has an upper surface and a lower surface. The upper surface is secured to the outer surface of the lower portion of the leather outer layer.

2 Claims, 3 Drawing Sheets

SAND SOCCER BOOT

BACKGROUND OF THE INVENTION

1. Field of the Invention

The present invention relates to a sand soccer boot and more particularly pertains to providing appropriate footwear for performing sports on the beach with a sand soccer boot.

2. Description of the Prior Art

The use of shoes is known in the prior art. More specifically, shoes heretofore devised and utilized for the purpose of protecting feet are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 253,316 to Hall discloses the ornamental design for a fabric shoe.

U.S. Pat. No. Des. 321,971 to Bajork discloses the ornamental design for foot covering for beach and pool.

U.S. Pat. No. 3,430,365 to Dee discloses a low cut sports shoe.

U.S. Pat. No. 5,087,217 to Tuan et al. discloses a swimming shoe having the shape of a sandal.

U.S. Pat. No. 5,138,776 to Levin discloses a sports shoe which has a highly elastic heel which reduces the shock on the foot during running and jogging.

While these devices fulfill their respective, particular objective and requirements, the aforementioned patents do not describe a sand soccer boot that provides appropriate footwear for performing sports on the beach.

In this respect, the sand soccer boot according to the present invention substantially departs from the conventional concepts and designs of the prior art, and in doing so provides an apparatus primarily developed for the purpose of providing appropriate footwear for performing sports on the beach.

Therefore, it can be appreciated that there exists a continuing need for a new and improved sand soccer boot which can be used for providing appropriate footwear for performing sports on the beach. In this regard, the present invention substantially fulfills this need.

SUMMARY OF THE INVENTION

In the view of the foregoing disadvantages inherent in the known types of shoes now present in the prior art, the present invention provides an improved sand soccer boot. As such, the general purpose of the present invention, which will be described subsequently in greater detail, is to provide a new and improved sand soccer boot and method which has all the advantages of the prior art and none of the disadvantages.

To attain this, the present invention essentially comprises a soft foam elastomer layer having an inner layer, an outer layer, a lower portion, an upper portion, and an ankle portion. The ankle portion has a first end and a second end. The first end extends upward from a first end of the lower portion. The upper portion has a first end and a second end. The first end gradually extends upward from a second end of the lower portion. The second end of the ankle portion and the second end of the upper portion integrally form an open recess for the insertion of a foot. The open recess has an elastic foam forming ankle support thereattached. The ankle support serves to conform to a user's ankle to prevent sand from entering. The device contains a leather outer layer having an inner surface, an outer surface, a lower portion, an upper portion, and an ankle portion. The inner surface is secured to the outer layer of the soft foam elastomer layer. The ankle portion has a first end and a second end. The first end extends upward from a first end of the lower portion. The upper portion has a first end and a second end. The first end gradually extends upward from a second end of the lower portion. A plurality of air cushions are secured to the outer surface of the upper portion. The device contains an elastomer sole having an upper surface and a lower surface. The upper surface is secured to the outer surface of the lower portion of the leather outer layer. The lower surface has a plurality of gripping agents thereon. A plastic securement hook is secured to the outer surface of the upper portion of the leather outer layer upward of the plurality of air cushions thereon. The hook has an oblong aperture therethrough. A leather strap has a first end and a second end. The outer layer having an inner surface, an outer surface, a lower portion, an upper portion, and an ankle portion. The inner surface is secured to the outer layer of the soft foam elastomer layer. The ankle portion has a first end and a second end. The first end extends upward from a first end of the lower portion. The upper portion has a first end and a second end. The first end gradually extends upward from a second end of the lower portion. A plurality of air cushions are secured to the outer surface of the upper portion. The device contains an elastomer sole having an upper surface and a lower surface. The upper surface is secured to the outer surface of the lower portion of the leather outer layer. The lower surface has a plurality of gripping agents thereon. A plastic securement hook is secured to the outer surface of the upper portion of the leather outer layer upward of the plurality of air cushions thereon. The hook has an oblong aperture therethrough. A leather strap has a first end and a second end. The first end is secured to the outer surface of the upper portion of the leather outer layer diametrically opposed from the plastic securement hook. The second end has a first pile fastener thereattached and a second pile fastener inward of the first pile fastener. The first pile fastener is optionally received through the oblong aperture of the plastic securement hook and removably coupled to the second pile fastener to secure the boot to the user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sand soccer boot which has all the advantages of the prior art shoes and none of the disadvantages.

It is another object of the present invention to provide a new and improved sand soccer boot which may be easily and efficiently manufactured and marketed.

It is a further object of the present invention to provide a new and improved sand soccer boot which is of durable and reliable construction.

An even further object of the present invention is to provide a new and improved sand soccer boot which is susceptible of a low cost of manufacture with regard to both materials and labor, and which accordingly is then susceptible of low prices of sale to the consuming public, thereby making such a sand soccer boot economically available to the buying public.

Still yet another object of the present invention is to provide a new and improved sand soccer boot which provides in the apparatuses and methods of the prior art some of the advantages thereof, while simultaneously overcoming some of the disadvantages normally associated therewith.

Even still another object of the present invention is to provide a new and improved sand soccer boot for providing appropriate footwear for performing sports on the beach.

Lastly, it is an object of the present invention to provide a new and improved sand soccer boot with a soft foam elastomer layer having an inner layer, an outer layer, a lower portion, an upper portion, and an ankle portion. The ankle portion and the upper portion integrally form an open recess for insertion of a foot. The open recess has an elastic foam forming ankle support thereattached. The ankle support serves to conform to a user's ankle to prevent sand from entering. A leather outer layer has an inner surface, an outer surface, a lower portion, an upper portion, and an ankle portion. The inner surface is secured to the outer layer of the soft foam elastomer layer. An elastomer sole has an upper surface and a lower surface. The upper surface is secured to the outer surface of the lower portion of the leather outer layer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
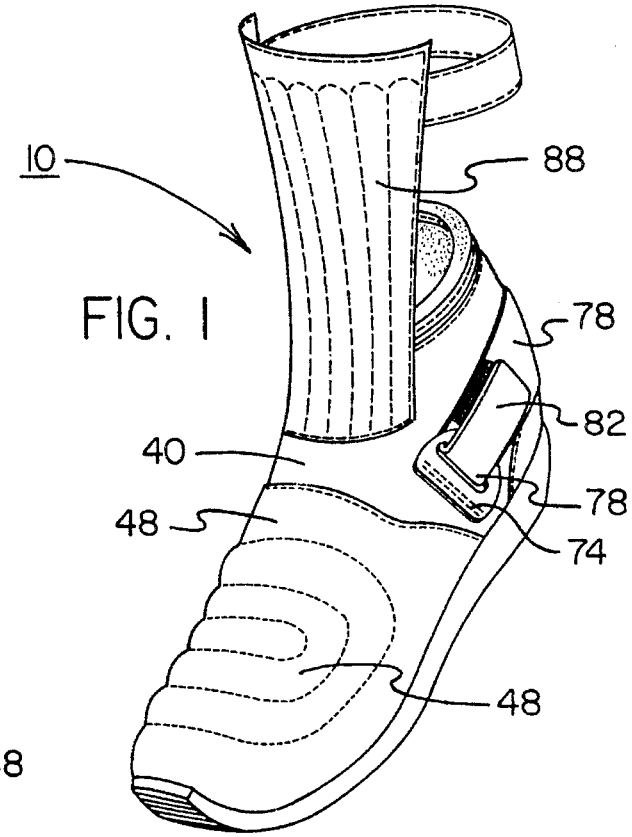
FIG. 1 is a perspective view of the preferred embodiment of the sand soccer boot constructed in accordance with the principles of the present invention.
Figure 2:
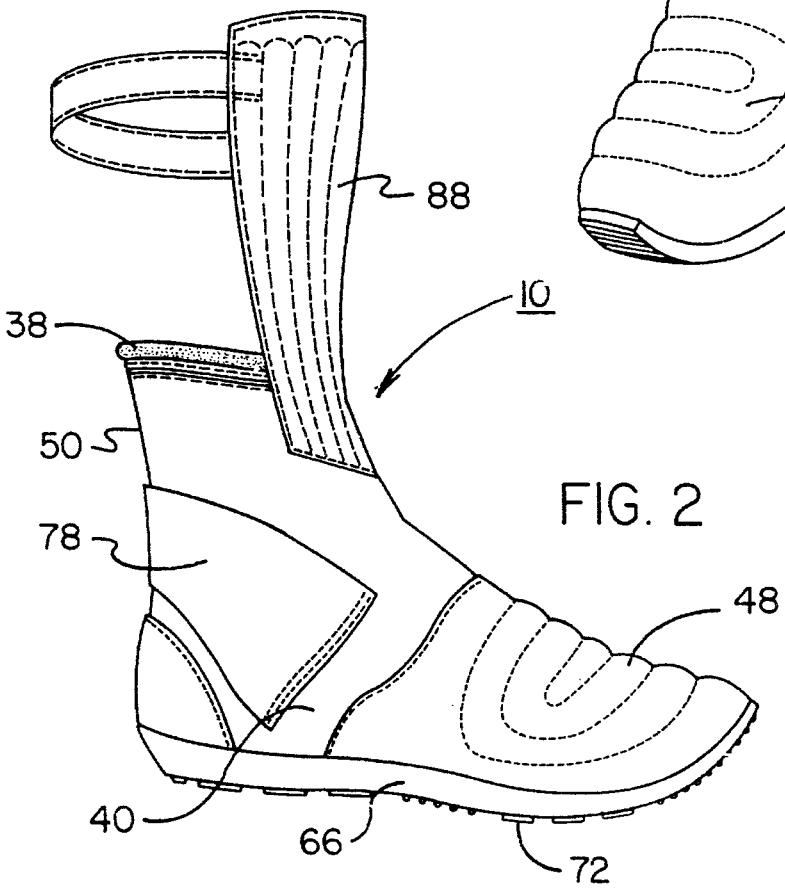
FIG. 2 is a side view of the preferred embodiment of the present invention.
Figure 4:
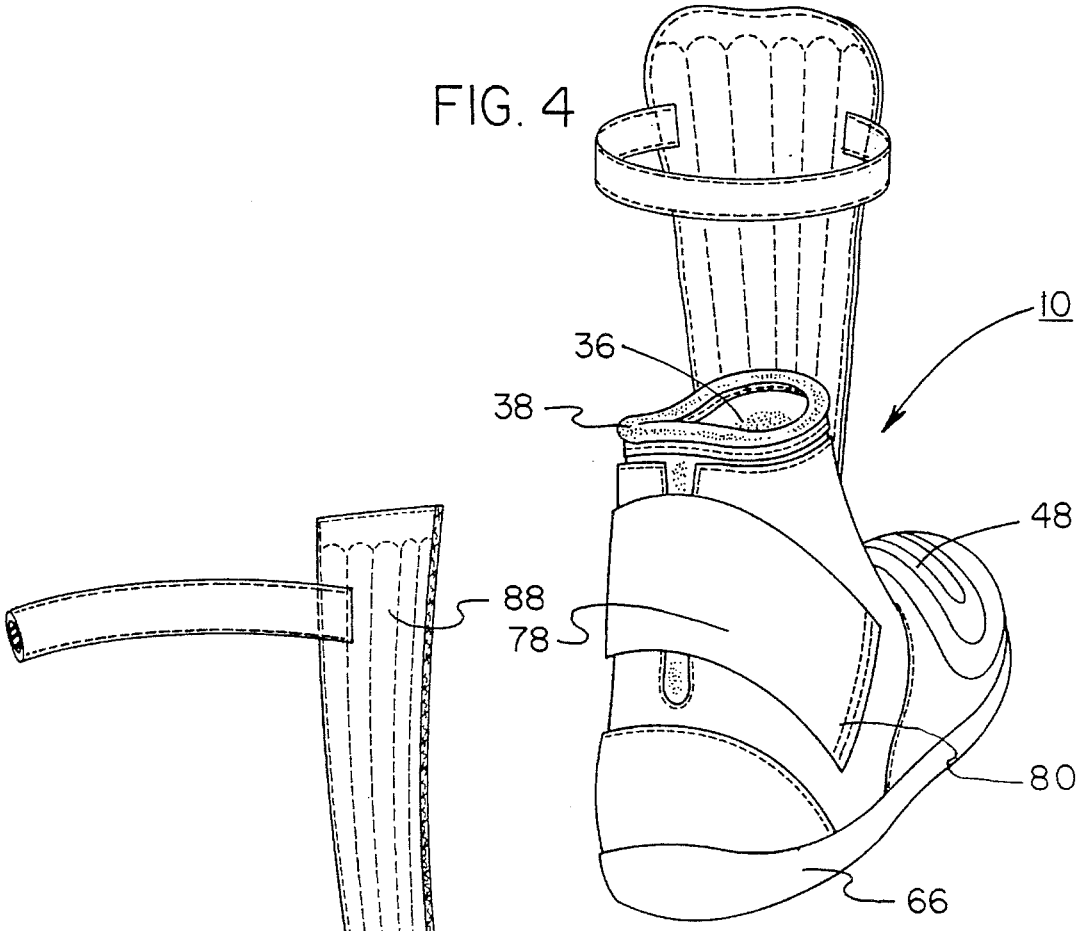
FIG. 4 is a rear view of the present invention showing the fit adjustment strap.
Figure 3:
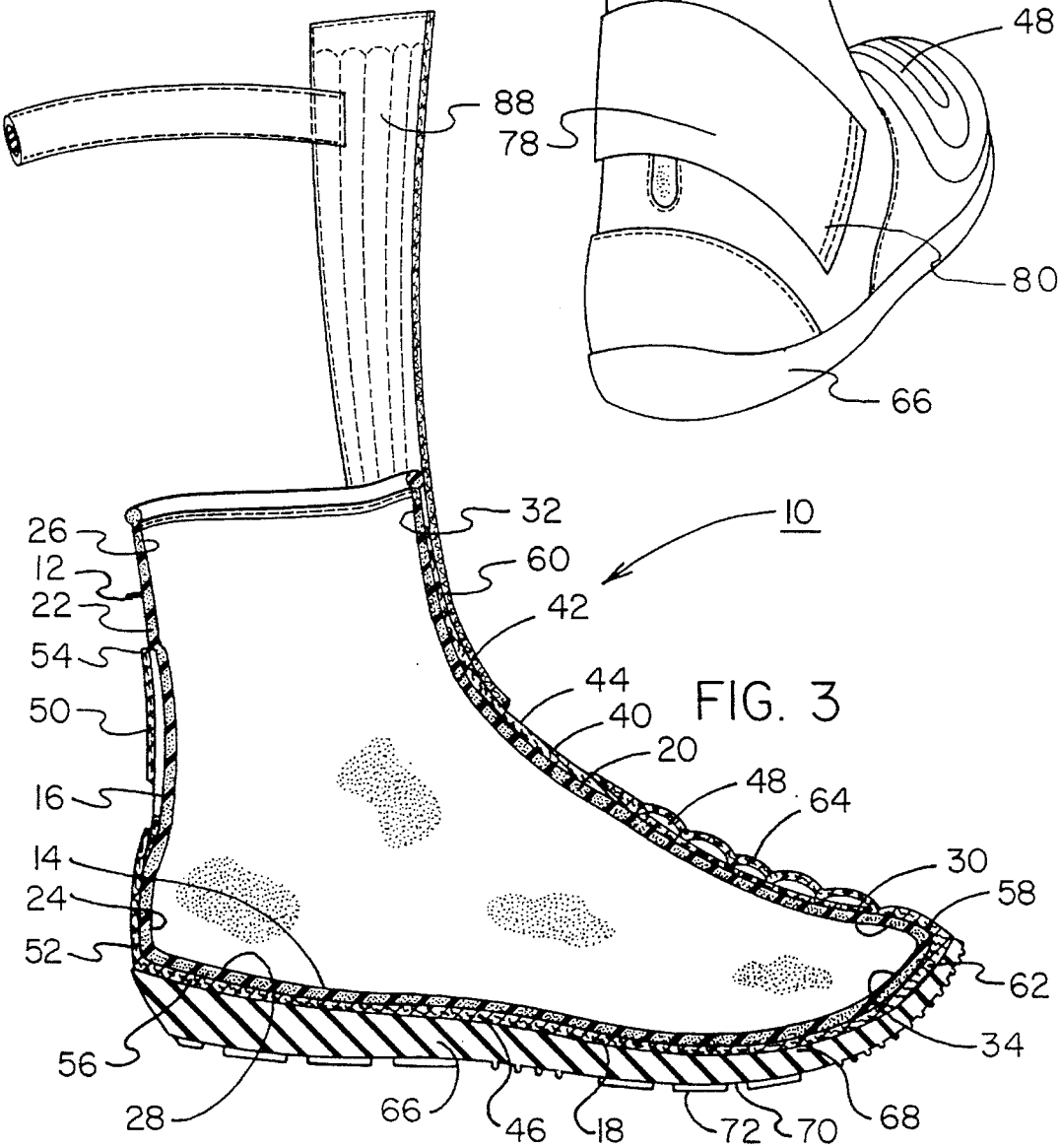
FIG. 3 is a cross-sectional side view of the present invention showing the three different layers.
Figure 5:
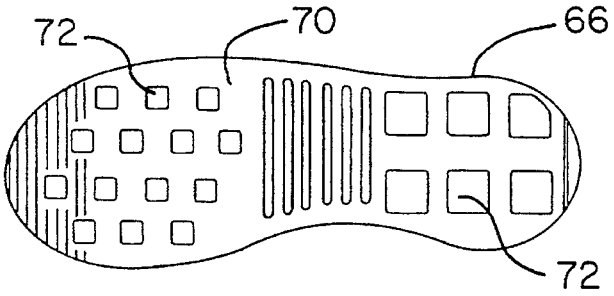
FIG. 5 is a bottom view of the present invention showing the sole pattern design.
Figure 6:
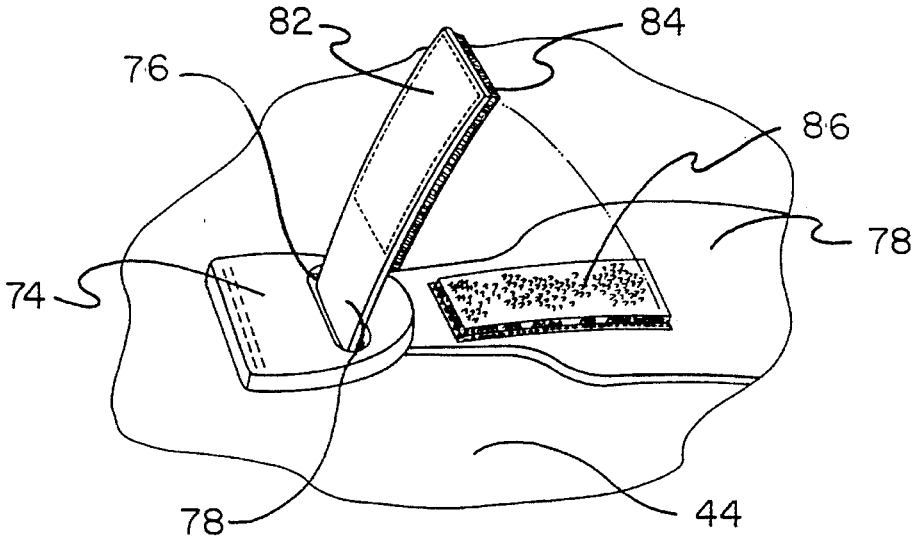
FIG. 6 is an enlarged view of the pile fasteners of the fit adjustment strap.

With reference now to the drawings, and in particular, to FIG. 1 thereof, the preferred embodiment of the new and improved sand soccer boot embodying the principles and concepts of the present invention and generally designated by the reference number 10 will be described.

Specifically, it will be noted in the various Figures that the device relates to a new and improved sand soccer boot for providing appropriate footwear for performing sports on the beach. In its broadest context, the device consists of a soft foam elastomer layer, a leather outer layer, an elastomer sole, and a plastic securement hook.

The device 10 contains a soft foam elastomer layer 12 having an inner layer 14, an outer layer 16, a lower portion 18, an upper portion 20, and an ankle portion 22. The ankle portion 22 has a first end 24 and a second end 26. The first end 24 extends upward from a first end 28 of the lower portion 18. The upper portion 20 has a first end 30 and a second end 32. The first end 30 gradually extends upward from a second end 34 of the lower portion 18. The second end 26 of the ankle portion and the second end 32 of the upper portion 20 integrally form an open recess 36 for the insertion of a foot. The open recess 36 has an elastic foam forming ankle support 38 thereattached. The ankle support 38 serves to conform to a user's ankle to prevent sand from entering and further serves to protect the user from injuring their ankle while enduring the rigors of sport. The thickness of the ankle support 38 can vary as to the preference of the user, ranging from thin foam for little protection to thick foam for those with chronic ankle problems.

The device 10 contains a leather outer layer 40 having an inner surface 42, an outer surface 44, a lower portion 46, an upper portion 48, and an ankle portion 50. The inner surface 42 is secured to the outer layer 16 of the soft foam elastomer layer 12. The ankle portion 50 has a first end 52 and a second end 54. The first end 52 extends upward from a first end 56 of the lower portion 46. The upper portion 48 has a first end 58 and a second end 60. The first end 58 gradually extends upward from a second end 62 of the lower portion 46. A plurality of air cushions 64 are secured to the outer surface 44 of the upper portion 48. The preferred composition of the leather outer layer 40 is a synthetic leather that is inexpensive to produce and also light in weight.

The device 10 contains an elastomer sole 66 having an upper surface 68 and a lower surface 70. The upper surface 68 is secured to the outer surface 44 of the lower portion 46 of the leather outer layer 40. The lower surface 70 has a plurality of gripping agents 72 thereon. The plurality of gripping agents 72 resemble different geometric shapes that give different angles for gripping the sand surface.

A plastic securement hook 74 is secured to the outer surface 44 of the upper portion 48 of the leather outer layer 40 upward of the plurality of air cushions thereon 64. The hook 74 has an oblong aperture 76 therethrough. A leather strap 78 has a first end 80 and a second end 82. The first end 80 is secured to the outer surface 44 of the upper portion 48 of the leather outer layer 40 diametrically opposed from the plastic securement hook 74. The second end 82 has a first pile fastener 84 thereattached and a second pile fastener 86 inward of the first pile fastener 84. The first pile fastener 84 is optionally received through the oblong aperture 76 of the plastic securement hook 74 and removably coupled to the second pile fastener 86 to secure the boot to the user.

A second embodiment of the present invention includes substantially all of the components of the present invention further including wherein a shin protection device 88 is secured to the elastic foam forming ankle support 38 of the soft foam elastomer layer 12. The shin protection device 88 is necessary for those times when playing soccer or another sport and contact is unavoidable.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved sand soccer boot for providing appropriate footwear for performing sports on the beach comprising, in combination:

a soft foam elastomer layer having an inner layer, an outer layer, a lower portion, an upper portion, and an ankle portion, the ankle portion having a first end and a second end, the first end extending upward from a first end of the lower portion, the upper portion having a first end and a second end, the first end gradually extending upward from a second end of the lower portion, the second end of the ankle portion and the second end of the upper portion integrally forming an open recess for insertion of a foot, the open recess having an elastic foam forming ankle support thereattached and extending upwardly therefrom, the ankle support serving to conform to a users ankle to prevent sand from entering;

a leather outer layer having an inner surface, an outer surface, a lower portion, an upper portion, and an ankle portion, the inner surface secured to the outer layer of the soft foam elastomer layer, the ankle portion having a first end and a second end, the first end extending upward from a first end of the lower portion, the upper portion having a first end and a second end, the first end gradually extending upward from a second end of the lower portion, a plurality of air cushions secured to the outer surface of the upper portion;

an elastomer sole having an upper surface and a lower surface, the upper surface secured to the outer surface of the lower portion of the leather outer layer, the lower surface having a plurality of gripping agents thereon; and a plastic securement hook secured to the outer surface of the upper portion of a heel portion of the leather outer layer upward of the plurality of air cushions thereon, the hook having an oblong aperture therethrough, a leather strap having a first end and a second end, the first end secured to the outer surface of the upper portion of the leather outer layer diametrically opposed from the plastic securement hook, the second end having a first pile fastener thereattached and a second pile fastener inward of the first pile fastener, the first pile fastener optionally received through the oblong aperture of the plastic securement hook and removably coupled to the second pile fastener to secure the boot to the user.

2. The soccer boot as described in claim 1 and further comprising wherein a shin protection device is secured to the elastic foam forming ankle support of the soft foam elastomer layer.

* * * * *